US005341851A

United States Patent [19]

Berktold et al.

[11] Patent Number: 5,341,851

[45] Date of Patent: Aug. 30, 1994

[54] LOOM HAVING AT LEAST TWO SECTIONAL WARP BEAMS

[75] Inventors: Klaus Berktold, Rüti; Ernst Eberhard, Wolfhausen, both of Switzerland

[73] Assignee: Sulzer Reuti AG, Reuti, Switzerland

[21] Appl. No.: 71,644

[22] Filed: Jun. 4, 1993

[30] Foreign Application Priority Data

Jun. 5, 1992 [EP] European Pat. Off. ..... 92810434.8

[51] Int. Cl.[5] ..... D03D 49/06

[52] U.S. Cl. ..... 139/103; 28/185; 66/212

[58] Field of Search ..... 33/778; 139/101, 103, 139/102; 66/212; 28/185

[56] References Cited

U.S. PATENT DOCUMENTS

| | | | |
|---|---|---|---|
| 3,668,904 | 6/1972 | Murenbeeld | 66/212 |
| 4,546,801 | 10/1985 | Bucher et al. | 139/103 X |
| 4,572,244 | 2/1986 | Kojima . | |
| 4,662,407 | 5/1987 | Duncan . | |
| 4,721,134 | 1/1988 | Dorman et al. | 139/102 X |
| 5,002,095 | 3/1991 | Herrin et al. | 139/105 X |
| 5,163,307 | 11/1992 | Jahn et al. | 139/105 X |
| 5,176,010 | 1/1993 | Wirth et al. | 66/212 |

FOREIGN PATENT DOCUMENTS 0136389 4/1985 European Pat. Off. .

*Primary Examiner*—Andrew M. Falik

*Attorney, Agent, or Firm*—Townsend and Townsend Khourie and Crew

[57] ABSTRACT

A loom with two or more sectional warp beam, each associated with a measuring device for detecting the length of at least one of the warp threads, which runs off the sectional beam in question during a given advance of warp thread. Each measuring device has a measuring roller which is urged against a number of warp threads, e.g., against the circumference of the wound sectional warp beam and which is driven by them during the advance of warp thread, so that it is able to transmit a corresponding control signal to a control equipment. The control equipment regulates the r.p.m. of the sectional warp beams in dependence upon these control signals in the sense of keeping constant the predetermined length of any given warp thread advance. The invention is particularly useful for weaving off sectional warp beams having different winding diameters for assuring a homogeneous appearance of the weave across its entire width.

8 Claims, 1 Drawing Sheet

LOOM HAVING AT LEAST TWO SECTIONAL WARP BEAMS

BACKGROUND OF THE INVENTION

The invention is concerned with a loom having at least two sectional warp beams and a tension beam or roller for guiding warp threads running off the sectional warp beams. Each sectional warp beam is coupled to an individually drivable warp let-off motion device and sensors are provided for detecting the tension in the warp threads. Further, control equipment sets the r.p.m. of the sectional warp beams individually.

Such a loom, known from the EP patent 0 136 389, has sensors for the detection of the warp thread tension arranged between a stationary deflector for the warp threads, in the form of a rod connected after the sectional warp beams in the direction of run of the warp threads, and a tension roller which is arranged to pivot on a support beam parallel with the axis of the sectional warp beams. When weaving off two or more sectional warp beams each is driven individually in dependence upon control signals from the sensors at an r.p.m. selected so that all of the warp threads running off the sectional warp beams have essentially equal warp thread tensions. Any difference in the tension of the warp threads running off the sectional warp beams is immediately compensated for by appropriately changing the r.p.m. of the sectional warp beams.

In another known loom the tension roller is supported in bearings which are movable transversely to its axis and allow an oblique position of the tension roller with respect to the axis of the warp beam. Sensors associated with the ends of the tension roller enable an equalization of different warp thread tensions in the warp threads running off the sectional warp beams (German patent 27 58 816 and U.S. Pat. No. 4,262,706).

It has been found that such a regulation of the r.p.m. of the sectional warp beams, which is dependent only upon the tension of the warp threads, is not always adequate for achieving the same appearance in each of the lengths of cloth being woven off the sectional warp beams and thereby a quality of fabric which is constant across the whole width of weaving. In particular in the case of looms having high weft insertion capacities and/or having different diameters of the sectional warp beams it may happen that in spite of keeping the warp thread tension constant in the sectional warp sheets, the sectional warp beams are not woven off at the same time. Thus, sections of cloth with different lengths may be produced and/or separate sections of cloth may have a non-homogeneous appearance, in which case a seam or fold may form between the separate sections of cloth because of an unequal length of the separate sections.

SUMMARY OF THE INVENTION

An objective of the invention is to create an improved loom which has a warp let-off motion that assures a homogeneous appearance of the cloth over the whole width of weaving even when using sectional warp beams of different diameters of wound thread, e.g., when processing stocks of warp yarn on partially woven-off sectional warp beams for using up residual warp.

In accordance with the present invention, measuring devices which detect the length of a given warp thread advance enable warp thread to be advanced independently of the respective diameters of wound thread on the sectional warp beams and at a constant rate over the whole weaving width of the loom. In this manner warp threads running off the individual sectional warp beams can be woven together without the previously described irregularities which may occur when the warp let-off motion is regulated solely in dependence of the warp thread tension. The control of the warp let-off motion in accordance with the invention allows the production both of a length of cloth over the full weaving width of the loom and of divided lengths or sections of cloth the widths of which correspond to the widths of the sectional warp beams, or of divided lengths of cloth which, by way of subsequent partition of a single length of cloth, may be woven independent of the widths of the sectional warp beams.

The control of the warp let-off motion in accordance with the invention also allows one to influence the consumption of warp yarn in the processing of weft yarns which, because of different elongation or a decrease in tension at the end of the weft insertion process before the change of shed, i.e., before binding in by the warp threads, may lead to different thicknesses. When the warp let-off is exclusively controlled in dependence on the warp thread tension, beat-up density and resulting visible irregularities in the weave can occur because wrapping weft yarns of different thicknesses can result in a correspondingly differing angle of wrap of the warp threads, or a correspondingly differing advance of warp thread can occur. By controlling the warp let-off motion in accordance with the invention in dependence upon a predetermined consumption of warp yarn, irregularities of this type are avoided.

DETAILED DESCRIPTION OF THE PREFERRED EMBODIMENTS

Figure 1:
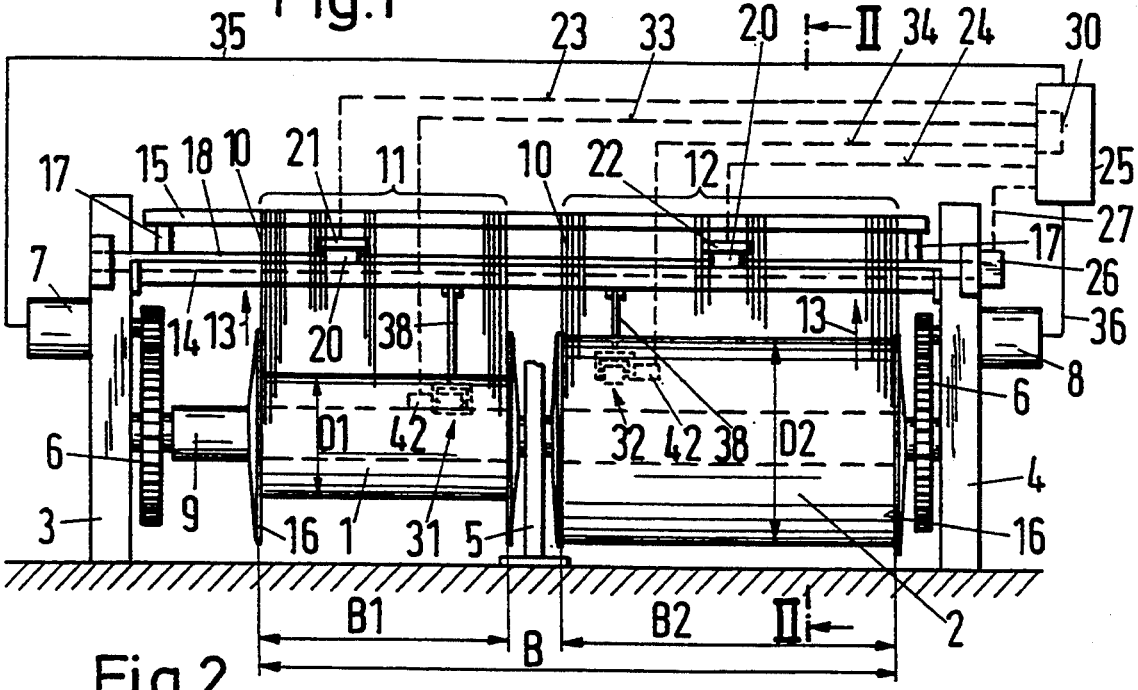
FIG. 1 shows a loom constructed in accordance with the invention in elevation seen from the warp side.

The loom according to FIG. 1 contains two sectional warp beams 1 and 2 which are arranged between two supports 3 and 4 of a loom frame. The two warp beams have different partial weave widths B1 and B2 as well as different wound thread or lap diameters D1 and D2. The sectional warp beams 1 and 2 are each supported by bearings (not shown) mounted to lateral supports 3 and 4 and to a central support 5. Each drum is connected via gearing 6 to a respective, separately controllable driving motor 7 and 8. The sectional warp beams 1 and 2 are wound with warp threads 10 which are unwound as separate or divided warps 11 and 12 in the direction of arrows 13 along a path 10' shown in dotted line. The warp threads 10 are guided over a deflector 14 in the form of a stationary rod secured to the loom frame and a tension beam or roller 15 positioned behind the latter in the direction of warp movement (arrow 13). From there the warps are guided over further parts (not shown) of the loom such as healds, reed, etc. towards the cloth beam. As is illustrated, the deflector 14 and the tension roller 15 extend over the whole width of weave B of the loom which is determined by the adjustable distance between the two outer warp beam discs 16 of the sectional warp beams 1 and 2.

Figure 2:
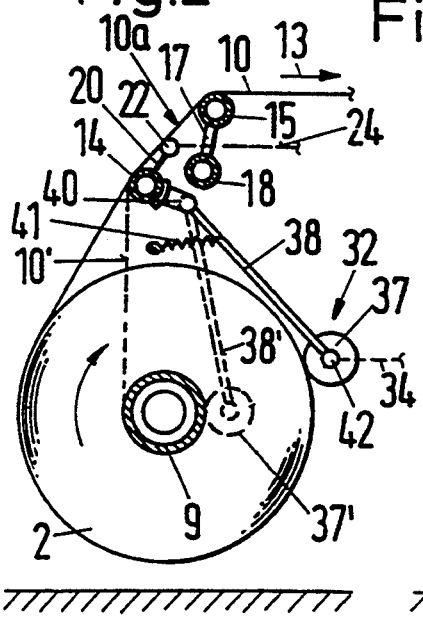
FIG. 2 is an enlarged partial section of the loom taken along the line II—II of FIG. 1.

The tension beam or roller 15 is carried by an arm 17 secured to a support beam 18 which is mounted as known, e.g., from the EP patent 01 09 472, so that it can pivot relative to the loom frame. As shown in FIG. 2, a torsion bar spring (not shown) biases the tension beam in a counterclockwise direction. The tension roller 15, which pivots about the axis of the support beam 18, is accordingly spring-biased against the warp threads 10 and the tension of the separate warps 11 and 12 is being taken up by the spring bar. Two sensors 21 and 22 of a device not shown in further detail detect the tension in the warp threads 10, are associated with the respective divided warps 11 and 12, and are secured to deflector 14 with spring mountings 20. As is known from EP patent 0 136 389, a number of, e.g., 100, warp threads 10 are led over each of the sensors 21 and 22. The sensors 21 and 22 generate control signals corresponding to the tension in the warp threads 10 of the divided warp 11 and 12 which are transmitted to a common control equipment 25 via signal leads 23 and 24. As is shown in FIG. 1, an additional sensor 26 may be provided at one end of support beam 18 for the detection of a supporting force resulting from the sum of the forces from the warp tensions in the divided warps 11 and 12. A control signal corresponding to this supporting force may be transmitted to the control equipment 25 over a signal line 27.

Measuring devices 31 and 32 are further associated with the respective sectional warp beams 1 and 2 for detecting the length of warp threads 10 running off during a warp thread advance from the respective sectional warp beams 1 or 2. Control signals generated by measuring devices 31 and 32 are fed over respective signal leads 33 and 34 to control equipment 25. These control signals correspond to the detected length of separate warps 11 or 12 running off the sectional warp beam 1 or 2. Control leads 35, 36 connect control equipment 25 with the driving motors 6 and 7 which set the warp let-off speed from the sectional warp beams 1 and 2 in dependence upon a predetermined combination of the control signals obtained from sensors 21, 22 and sensor 26, and the control signals obtained from the measuring devices 31 and 32.

As shown in FIGS. 1 and 2, each measuring device 31 and 32 may include a measuring roller 37 rotatably carried on a holder 38 which can move towards and away from the circumference of the divided warp beams 1 or 2. Each holder 38 may be pivotable relative to a stationary support, such as a bracket 40 mounted to the deflector 14, between the position shown in solid line and a position 38' shown in dotted line. A spring 41 may bias the holder towards the circumference of the sectional warp beam 1 or 2. As the diameter of wound warp thread decreases, measuring roller 37 is steadily urged against the circumference of the wound sectional warp beam 1 or 2 and set in rotation by the latter through an angle which corresponds to the advance of warp thread. A sensor 42 associated with the measuring roller 37 generates a control signal which corresponds to this angle of rotation and is transmitted via the signal lead 33 or 34 to the control equipment 25.

Figure 3:
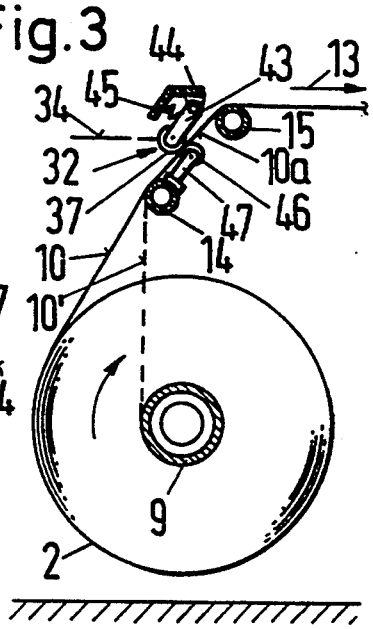
FIGS. 3 and 4 are corresponding partial sections of further embodiments of the looms.

Such measuring devices 31 and 32 may also be located some distance from the sectional warp beams 1 and 2, as shown in FIG. 3, in the region of warp portion 10*a* running between the deflector 14 and the tension roller 15. In this embodiment the measuring rollers 37 may each be supported on a holder 43 which is accessible from the warp side of the loom and mounted to a stationary support part 44 so that it may be biased, say, with a spring 45 shown as a compression spring, against the warp threads 10 running over a supporting roller 46. The supporting rollers 46 may each be carried on a bracket 47 mounted to the deflector 14. Instead of a rotating supporting roller, another guide member, e.g., a supporting plate, may be provided. Apart from the advantage of providing access to the measuring devices 31 and 32 from the warp side, this embodiment has the additional advantage that the length of advancing warp threads 10 is detected in a region of the warp thread where, as a result of the deflection of the warps by deflector 14, they are kept still so that all the warp threads 10 have essentially the same warp thread tension independent of the state of wind of the sectional warp beam 1 or 2 at the time. This assures that the advance of warp thread which is detected in the region of measurement corresponds to the actual advance of the entire separate warp 11 or 12.

Figure 4:
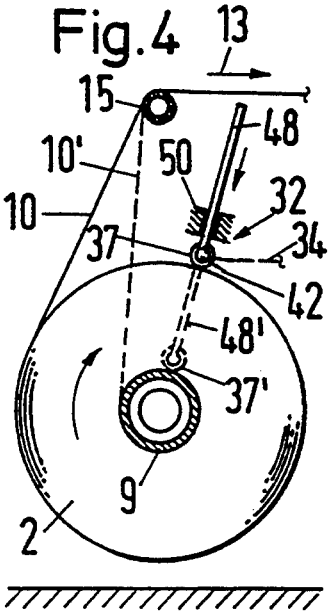

Referring to FIG. 4, the measuring rollers 37 may optionally be mounted on a rod-like holder 48 which is guided to move radially with respect to the axis of the sectional warp beam 1 or 2 in a stationary guide 50 between the position shown in solid line and a position 48' shown in dotted line. The dead weight of holder 48 or the force of a spring (not shown) urges the measuring roller 37 against the circumference of the wound sectional warp beam 1 or 2. As further appears from FIG. 4, the warp threads 10 from the sectional warp beam 1 or 2 may also be led directly towards the tension roller 15 which, in the illustrated embodiment, can be supported in lateral, spring-mounted bearings (not shown). In such an event a known sensor for detecting the supporting force, say, corresponding to the sensor 26 in FIG. 1, may be provided for each end of the tension roller 15 for generating the control signal corresponding to the supporting force, and thereby the distribution of the warp tension forces, and which is then transmitted to the control equipment 25.

Alternatively, the tension roller can be supported in fixed bearings provided with appropriate sensors. Further, instead of a tension roller which is continuous over the entire weaving width, sectional tension rollers can be provided similar to the associated sectional warp beams 1 and 2.

The driving motors 7 and 8 may each be so energized via the control equipment 25 to correspond with the control signals from the sensors 21, 22 and 26 (which detect the tension in the warp threads 10), and the measuring devices 31 and 32 (which detect the length of the warp thread 10 running off at any time), that the (divided) separated warps 11 and 12 have the same run-off speed. In such an event the control leads 33 and 34 from the measuring devices 31 and 32 may be connected to the control equipment 25 via a control unit 30 (shown in FIG. 1), which may optionally be switched and through which the control signals from the sensors 21, 22 and 26 on the one hand and the control signals from the measuring devices 31 and 32 on the other are weighted in a predetermined ratio—e.g., at 40% in dependence upon the tension and at 60% in dependence upon the length of the warp threads 10 running off at the time—for controlling the warp let-off motion.

The proportions of these control signals may be varied between 0 and 100%. For example, in the processing of sectional warp beams 1 and 2 having the same winding diameters, the detection of the length of the warp thread advance may be waived and the warp let-off motions may be exclusively controlled with sensors 21, 22 and 26 detecting the tension in the warp threads 10. On the other hand, especially when processing sectional warp beams 1 and 2 having different winding diameters, the driving motors 7 and 8 can be energized exclusively in dependence upon the control signals from the measuring devices 31 and 32.

It is apparent that with control equipment 25 or control unit 30 any proportional combination of these control signals may be set and used for controlling the warp let-off motions. Thus, when setting the loom the warp thread tension and the warp thread consumption are preselected and weighted to be most advantageous for the desired quality of weave. For example, when processing warp threads 10 of low elasticity a correspondingly preponderant proportion of signals detecting the warp thread consumption may be taken into consideration. Conversely, for processing warp threads 10 of higher elasticity a correspondingly preponderant proportion of control signals detecting the warp thread tension can be used.

Figure 5:
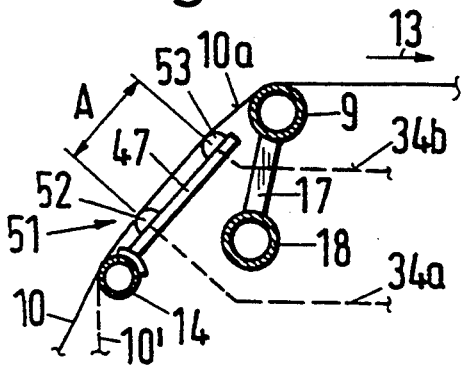
FIG. 5 is an enlarged detail of a loom and illustrates a further embodiment of the invention.
Figure 6:
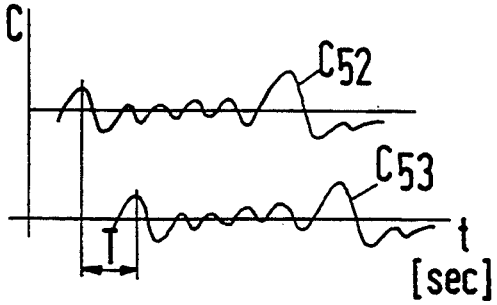
FIG. 6 is a graph of control signals generated with the embodiment shown in FIG. 5.

Referring to FIG. 5, instead of the mechanical measuring devices 31 and 32, corresponding measuring devices 51 for directly measuring the advance of warp threads may be used. Each device contains sensors 52 and 53, spaced one behind the other over an interval A in the running direction (arrow 13) of the warp threads 10. The sensors are responsive to the structure of the warp thread 10, or group of warp threads, running past them and generate two signals similar to one another as determined by the yarn structure. The graph of FIG. 6 represents the course of the two control signals C52 and C53 which follow one another at a time interval T corresponding to the advance of warp thread. They are transmitted via signal leads 34*a* and 34*b*, respectively, to the control equipment 25 and compared with one another, for example, with correlation methods. From this shift of the two signals with respect to time, the speed v of the warp thread 10 running between the sensors 52 and 53 may be derived according to the equation $$v=A/T$$

and thereby the length s of the advance of warp thread at the time may be determined according to the equation $$s=v.T.$$

Capacitive, optical or piezo-electric elements may be employed as the sensors.

Instead of the sensors 52 and 53 described above, other sensors, e.g., ultraviolet sensors, may be provided, each of which responds to markings applied to the warp thread 10 in question or to a group of warp threads, say, in the form of color marks applied to them. The length measuring devices 31, 32, 51 provided in accordance with the invention and the corresponding control unit 30 may also be retrofitted on existing looms and connected to existing warp let-off control equipment capable of being influenced in dependence upon the warp thread tension.

The present invention may also be used with looms having sectional warp beams arranged in parallel with one another and/or having more than two, e.g., three or four, sectional warp beams, each warp beam being provided with a length measuring device described above.

What is claimed is:

1. A loom comprising at least two sectional warp beams about which warp threads are wound and from which warp threads are run off during weaving; tensioning means for guiding the warp threads being run off; first sensing means for each sectional warp beam for detecting tension in the warp threads being run off the beams; control equipment operatively coupled with the first sensing means for regulating a rate or rotation of the warp beams when warp threads are run off; second sensing means provided for each warp beam for detecting a length of warp thread being run off the associated sectional warp beam for a given advance of warp thread from the beam during weaving, the second sensing means generating a control signal reflecting said length of warp thread run off during said given advance; and means for feeding the control signal from the second sensing means to the control equipment; the control equipment being adapted to influence the rate of rotation of the section warp beams in dependence on said control signal for maintaining constant the length of warp thread being run off the warp beams during the given advance of the warp threads.

2. A loom according to claim 1 wherein the second sensing means comprises means for feeling warp thread wound onto the sectional warp beam, and means for resiliently urging the feeling means against a periphery of the warp threads wound on the sectional warp beams.

3. A loom according to claim 1 including means spaced from the sectional warp beams for engaging the warp threads being advanced from the beams towards a weaving location; and wherein the second sensing means engages at least some of the warp threads at a location downstream of the tension means in the direction of warp thread movement.

4. A loom according to claim 3 including a stationary guide member located downstream of the tensioning means and engaging at least some of the warp threads emanating from the associated sectional warp beam, and wherein the second sensing means is located proximate the guide member.

5. A loom according to claim 1 wherein the second sensing means comprises a rotatably mounted sensing roller urged against at least some of the warp threads emanating from the associated warp beam; means for resiliently urging the sensing roller against the at least some warp threads so that, upon an advance of the warp threads, they rotate the roller; a sensor operatively coupled with the roller for generating a signal reflecting an angle of rotation of the roller and thereby responsive to the length of warp thread being advanced; and means for feeding the signal generated by the sensor to the control equipment.

6. A loom according to claim 1 wherein the second sensing means comprises first and second sensors positioned adjacent at least some of the warp threads being advanced from the sectional warp beam and spaced apart along the direction of movement of the warp threads, the sensors being adapted to generate first and second, similar control signals which are offset in time as a function of the spacing between the sensors, the sensors sensing a structure of at least one of the warp threads; and means for feeding the first and second control signals to the control equipment for modulating the rate of rotation of the warp beam.

7. A loom according to claim 1, including a control unit operatively coupled with the control equipment, with the first sensing means, and the second sensing means, the control unit being adapted to generate a warp beam speed control signal proportionally from the control signals generated by the first and second sensing means for controlling the rate of rotation of the warp beam during a given advance of warp thread.

8. A loom according to claim 7 wherein the control unit is adapted to vary the proportions of each of the control signals from the first and second sensing means from 0% to 100%.

* * * * *